US011187427B2

(12) United States Patent
Jaworski et al.

(10) Patent No.: US 11,187,427 B2
(45) Date of Patent: Nov. 30, 2021

(54) RECONFIGURABLE PORTABLE DEVICE AND SYSTEM FOR HVACR EQUIPMENT CONFIGURATION MANAGEMENT

(71) Applicant: Johnson Controls Technology Company, Auburn Hills, MI (US)

(72) Inventors: Szymon A. Jaworski, South Milwaukee, WI (US); Roy M. Rader, Fredonia, WI (US); Timothy J. Riesch, Germantown, WI (US); Kevin C. Luty, West Allis, WI (US); Alan D. Carlson, Columbus, WI (US); John P. Patterson, Waukesha, WI (US); Vanitha Aenugu, Pewaukee, WI (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 32 days.

(21) Appl. No.: 16/514,020

(22) Filed: Jul. 17, 2019

(65) Prior Publication Data

US 2020/0056801 A1 Feb. 20, 2020

Related U.S. Application Data

(60) Provisional application No. 62/718,693, filed on Aug. 14, 2018.

(51) Int. Cl.
*F24F 11/49* (2018.01)
*F24F 11/89* (2018.01)
(Continued)

(52) U.S. Cl.
CPC ..... *F24F 11/49* (2018.01); *F24F 11/38* (2018.01); *F24F 11/56* (2018.01); *F24F 11/89* (2018.01)

(58) Field of Classification Search
None
See application file for complete search history.

(56) References Cited

U.S. PATENT DOCUMENTS 7,821,218 B2 10/2010 Butler et al.
2003/0229796 A1* 12/2003 Shih ..... G06F 1/1632 713/193

(Continued)

OTHER PUBLICATIONS

MQP electronics Ltd. "USB Made Simple Part 3—Data Flow", copyright 2006-2008, copy from internet archive image on Jul. 16, 2018 ; URL<https://web.archive.org/web/20180716071809/http://www.usbmadesimple.co.uk/ums_3.htm> (Year: 2018).*

(Continued)

*Primary Examiner* — Kenneth M Lo
*Assistant Examiner* — Jonathan Michael Skrzycki
(74) *Attorney, Agent, or Firm* — Foley & Lardner LLP

(57) ABSTRACT

An illustrative embodiment disclosed herein is a portable device for managing heating, ventilation, air conditioning, and refrigeration (HVACR) equipment configuration. The portable device includes a memory, a user-operable switch having a read position and a write position, and a controller interface coupled to the memory and the user-operable switch. The controller interface is configured to be coupled to an HVACR controller. The controller interface is configured to detect whether the user-operable switch is in the read position or the write position. The controller interface is configured to, responsive to detecting that the user-operable switch is in the read position, execute a read operation comprising obtaining a first set of configuration parameters from the HVACR controller. The controller interface is configured to, responsive to detecting that the user-operable switch is in the write position, execute a write operation comprising sending the first set of configuration parameters to the HVACR controller.

20 Claims, 8 Drawing Sheets

(51) Int. Cl.
*F24F 11/38* (2018.01)
*F24F 11/56* (2018.01)

(56) References Cited

U.S. PATENT DOCUMENTS

| | | | | |
|---|---|---|---|---|
| 2005/0036396 | A1* | 2/2005 | Deng | G06F 3/0655 365/232 |
| 2009/0248967 | A1* | 10/2009 | Sharma | G06F 9/44505 711/103 |
| 2010/0298984 | A1 | 11/2010 | Mauk et al. | |
| 2014/0282458 | A1 | 9/2014 | Gupta | |
| 2017/0212487 | A1* | 7/2017 | Gupta | F24F 11/62 |

OTHER PUBLICATIONS

Merriam-Webster Dictionary, Definition of the word Coupled, retrieved from the internet on Jan. 5, 2021, URL:<https://www.merriam-webster.com/thesaurus/coupled> (Year: 2021).*

Origin Instruments, Swifty USB switch interface, archived at archive.org on Apr. 26, 2018, retrieved from the internet archive on Mar. 2, 2021, URL:<https://web.archive.org/web/20180426211057/https://www.orin.com/access/swifty/> (Year: 2018).*

* cited by examiner

RECONFIGURABLE PORTABLE DEVICE AND SYSTEM FOR HVACR EQUIPMENT CONFIGURATION MANAGEMENT

CROSS-REFERENCE TO RELATED PATENT APPLICATION

This application claims the benefit of and priority to U.S. Provisional Patent Application No. 62/718,693 filed Aug. 14, 2018, the entire disclosure of which is incorporated by reference herein.

BACKGROUND

The present disclosure relates generally to heating, ventilation, air conditioning, and refrigeration (HVACR) systems and more particularly to a controller for a HVACR system.

HVACR systems can be found in a wide variety of settings, including grocery stores, hotels, restaurants, office buildings, cafeterias, and other types of buildings or structures. In these HVACR systems, there are many parameters to be controlled. Generally, these parameters are controlled using one or more controllers that are programmed at their respective site to satisfy the demands of the particular application in which the HVACR system is used.

SUMMARY

An illustrative embodiment disclosed herein is a portable device for managing heating, ventilation, air conditioning, and refrigeration (HVACR) equipment configuration. The portable device includes a memory storing a first set of configuration parameters, device housing, a user-operable switch coupled to the device housing and having a read position and a write position, and a controller interface coupled to the memory and the user-operable switch. The controller interface is configured to be coupled to an HVACR controller. The controller interface is configured to detect whether the HVACR controller is coupled to the controller interface. The controller interface is configured to, responsive to detecting that the HVACR controller is coupled to the controller interface, detect whether the user-operable switch is in the read position or the write position. The controller interface is configured to, responsive to detecting that the user-operable switch is in the read position, execute a read operation comprising obtaining the first set of configuration parameters from the HVACR controller. The controller interface is configured to, responsive to detecting that the user-operable switch is in the write position, execute a write operation comprising sending the first set of configuration parameters to the HVACR controller.

In some embodiments, the read operation includes encoding a first command code requesting to read the first set of configuration parameters from the HVACR controller, sending a first command frame including the first command code to the HVACR controller, and receiving a response frame including the first set of configuration parameters from the HVACR controller in response to sending the first command frame.

In some embodiments, the user-operable switch is a first user-operable switch. The portable device may further include a second user-operable switch coupled to the device housing. The second user-operable switch may have an overwrite protect position and a non-overwrite protect position. The controller interface may be further configured to, responsive to detecting that the first user-operable switch is in the read position and the second user-operable switch is in the non-overwrite protect position, overwrite a second set of configuration parameters at address locations in the memory by storing the first set of configuration parameters at the address locations in the memory.

In some embodiments, the controller interface further configured to, responsive to detecting that the first user-operable switch is in the read position and the second user-operable switch is in the overwrite protect position, discard the first set of configuration parameters.

In some embodiments, the write operation includes encoding a second command code requesting the HVACR controller to save the first set of configuration parameters and sending a second command frame including the second command code and the first set of configuration parameters to the HVACR controller.

In some embodiments, the controller interface further configured to receive a first identifier from the HVACR controller and determine that the first identifier matches a second identifier corresponding to the portable device.

In some embodiments, the controller interface further configured to receive a first checksum from the HVACR controller, calculate a second checksum based on the first set of configuration parameters, and, responsive to determining that the second checksum matches the first checksum, determine that the first set of configuration parameters is not corrupt.

Another illustrative embodiment disclosed herein is a method for managing heating, ventilation, air conditioning, and refrigeration (HVACR) equipment configuration. The method includes detecting whether an HVACR controller is coupled to a controller interface. The method includes, responsive to detecting that the HVACR controller is coupled to the controller interface, detecting whether a user-operable switch coupled to device housing of a portable device is in a read position or a write position. The method includes, responsive to detecting that the user-operable switch is in the read position, executing a read operation comprising obtaining a first set of configuration parameters from the HVACR controller. The method includes, responsive to detecting that the user-operable switch is in the write position, executing a write operation comprising sending the first set of configuration parameters to the HVACR controller.

In some embodiments, the read operation includes encoding a first command code requesting to read the first set of configuration parameters from the HVACR controller, sending a first command frame including the first command code to the HVACR controller, and receiving a response frame including the first set of configuration parameters from the HVACR controller in response to sending the first command frame.

In some embodiments, the user-operable switch is a first user-operable switch. The method may further include detecting whether a second user-operable switch coupled to the device housing is in an overwrite protection position or a non-overwrite protection position and, responsive to detecting that the first user-operable switch is in the read position and the second user-operable switch is in the non-overwrite protect position, overwriting a second set of configuration parameters at address locations in a memory of the portable device by storing the first set of configuration parameters at the address locations in the memory.

In some embodiments, the method further includes, responsive to detecting that the first user-operable switch is in the read position and the second user-operable switch is in the overwrite protect position, discarding the first set of configuration parameters.

In some embodiments, the write operation includes encoding a second command code requesting the HVACR controller to save the first set of configuration parameters and sending a second command frame including the second command code and the first set of configuration parameters to the HVACR controller.

In some embodiments, the method further includes receiving a first identifier from the HVACR controller and determining that the first identifier matches a second identifier corresponding to the portable device.

In some embodiments, the method further includes receiving a first checksum from the HVACR controller, calculating a second checksum based on the first set of configuration parameters, and, responsive to determining that the second checksum matches the first checksum, determining that the first set of configuration parameters is not corrupt.

Another illustrative embodiment disclosed herein is a system for managing heating, ventilation, air conditioning, and refrigeration (HVACR) equipment configuration. The system includes an HVACR controller and a portable device including a memory storing a first set of configuration parameters, device housing, a user-operable switch coupled to the device housing and having a read position and a write position, and a controller interface coupled to the memory and the user-operable switch. The controller interface is configured to be coupled to the HVACR controller. The controller interface is configured to detect whether the HVACR controller is coupled to the controller interface. The controller interface is configured to, responsive to detecting that the HVACR controller is coupled to the controller interface, detect whether the user-operable switch is in the read position or the write position. The controller interface is configured to, responsive to detecting that the user-operable switch is in the read position, execute a read operation comprising obtaining the first set of configuration parameters. The controller interface is configured to, responsive to detecting that the user-operable switch is in the write position, execute a write operation comprising sending the first set of configuration parameters.

In some embodiments, the read includes encoding a first command code requesting to read the first set of configuration parameters from the HVACR controller, sending a first command frame including the first command code to the HVACR controller, and receiving a response frame including the first set of configuration parameters from the HVACR controller in response to sending the first command frame.

In some embodiments, the user-operable switch is a first user-operable switch. The portable device may further include a second user-operable switch coupled to the device housing. The second user-operable switch may have an overwrite protect position and a non-overwrite protect position. The controller interface may be further configured to, responsive to detecting that the first user-operable switch is in the read position and the second user-operable switch is in the non-overwrite protect position, overwrite a second set of configuration parameters at address locations in the memory by storing the first set of configuration parameters at the address locations in the memory.

In some embodiments, the controller interface further configured to, responsive to detecting that the first user-operable switch is in the read position and the second user-operable switch is in the overwrite protect position, discard the first set of configuration parameters.

In some embodiments, the write operation includes encoding a second command code requesting the HVACR controller to save the first set of configuration parameters and sending a second command frame including the second command code and the first set of configuration parameters to the HVACR controller.

In some embodiments, the portable device further includes a personal computer (PC) interface coupled to the memory and the user-operable switch. The system may further include a PC coupled to the PC interface. The PC may include a configuration manager configured to receive user selection of the first set of configuration parameters and, responsive to receiving the user selection of the first set of configuration parameters, store the first set of configuration parameters in the memory, via the PC interface.

DETAILED DESCRIPTION

Figure 1:
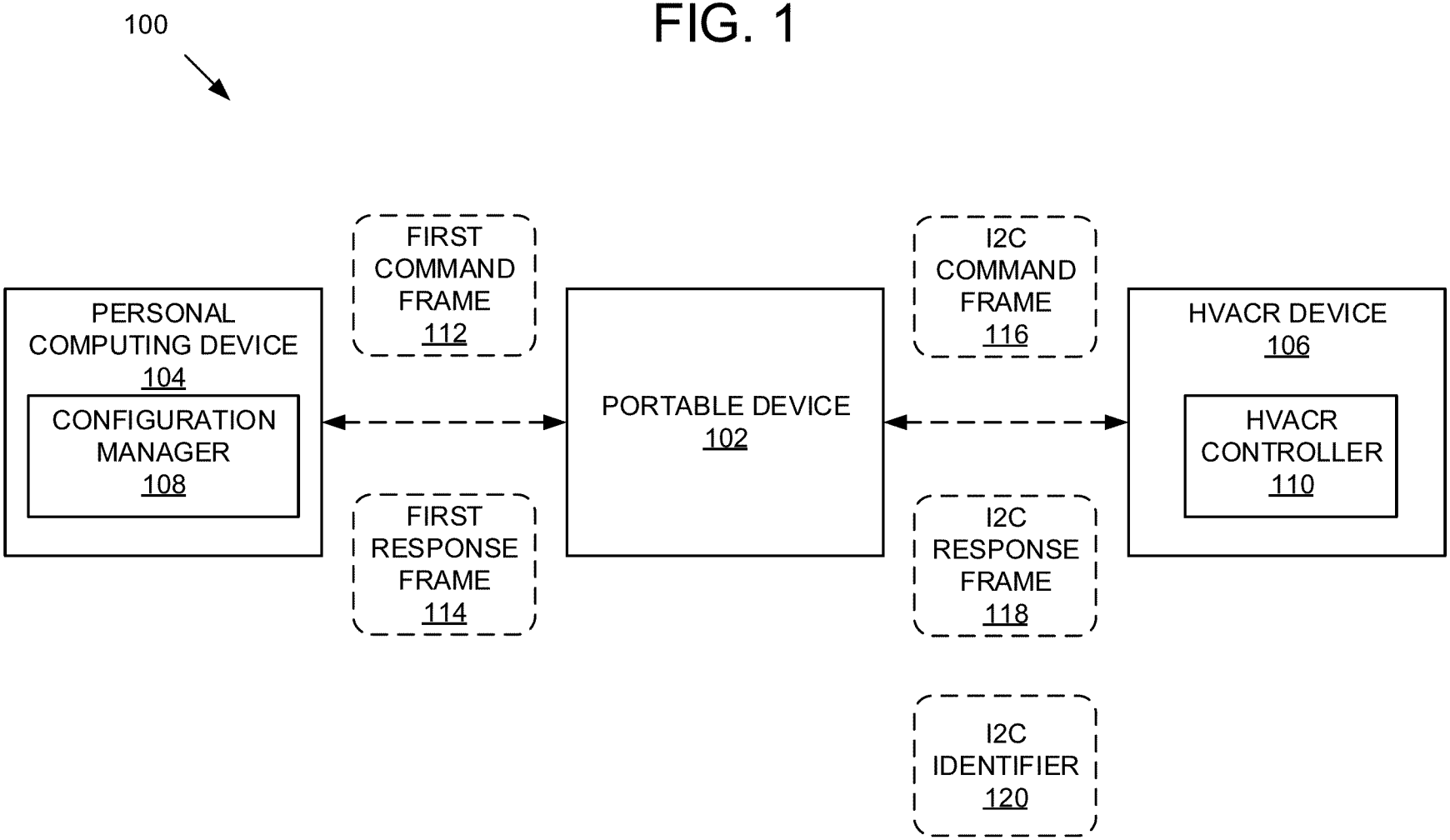
FIG. 1 is a block diagram of a HVACR controller system, according to an exemplary embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and make part of this disclosure.

In the heating, ventilation, air conditioning, and refrigeration (HVACR) systems, there are many parameters to be controlled. For example, commercial refrigeration systems may have controllers that are dedicated for control of humidity, pressure, temperature, and so forth, including set points or ranges for a number of different devices in the refrigeration system (e.g., fans, alarms, sensors). The parameters are set in a configuration file.

Such configuration files may be configured through a user interface located on the HVACR unit. However, using the local user interface is non-intuitive and too time consuming. Furthermore, the process of setting up all the parameters for each unit is error prone. In accordance with present embodiments, it is recognized that there is a technological need to equip such systems with reconfigurable, easy-to-use portable devices for the HVACR infrastructure.

Disclosed herein is reconfigurable portable device and system. The portable device may provide an intuitive user interface to users via physical switches and connectors on the portable device, and additionally or alternatively, via a configuration manager on a personal computing device. The portable device may automatically read a configuration file from an HVACR controller or write a configuration file to an HVACR controller in response to how the physical switches on the portable device are positioned. One advantage is that the portable device and system will reduce setup time from minutes down to seconds. Another advantage is a reduction in setup errors. The reduction in setup time and errors will result in efficiency improvements and a reduction in operational costs.

Advantageously, the portable device and system is reconfigurable by providing three modes of communication. In a first mode, the portable device can be connected to the personal computing device, such that a configuration file can be created or updated by the configuration manager and stored on the computing device. In a second mode, the portable device can be connected to an HVACR unit in order to load, save, or clone the configuration file. In pass through mode, the portable device can simultaneously be connected to the personal computing device and the HVACR unit, such that the configuration file of the HVACR unit can be updated directly from the configuration manager easy-to-use user interface. The reconfigurable portable device and system provides flexibility such that use of the reconfigurable portable device and system can be tailored to the preferences and policies of each end-user.

FIG. 1 is a block diagram of a HVACR controller system 100, according to an exemplary embodiment. The HVACR controller system 100 is shown to include a portable device 102, a personal computing device 104, and an HVACR device 106. In some embodiments, the portable device 102 connects to the personal computing device 104 or the HVACR device 106. In other embodiments, the portable device 102 connects to the personal computing device 104 and the HVACR device 106 simultaneously. In some embodiments, the portable device 102 is a flash drive.

Figure 2:
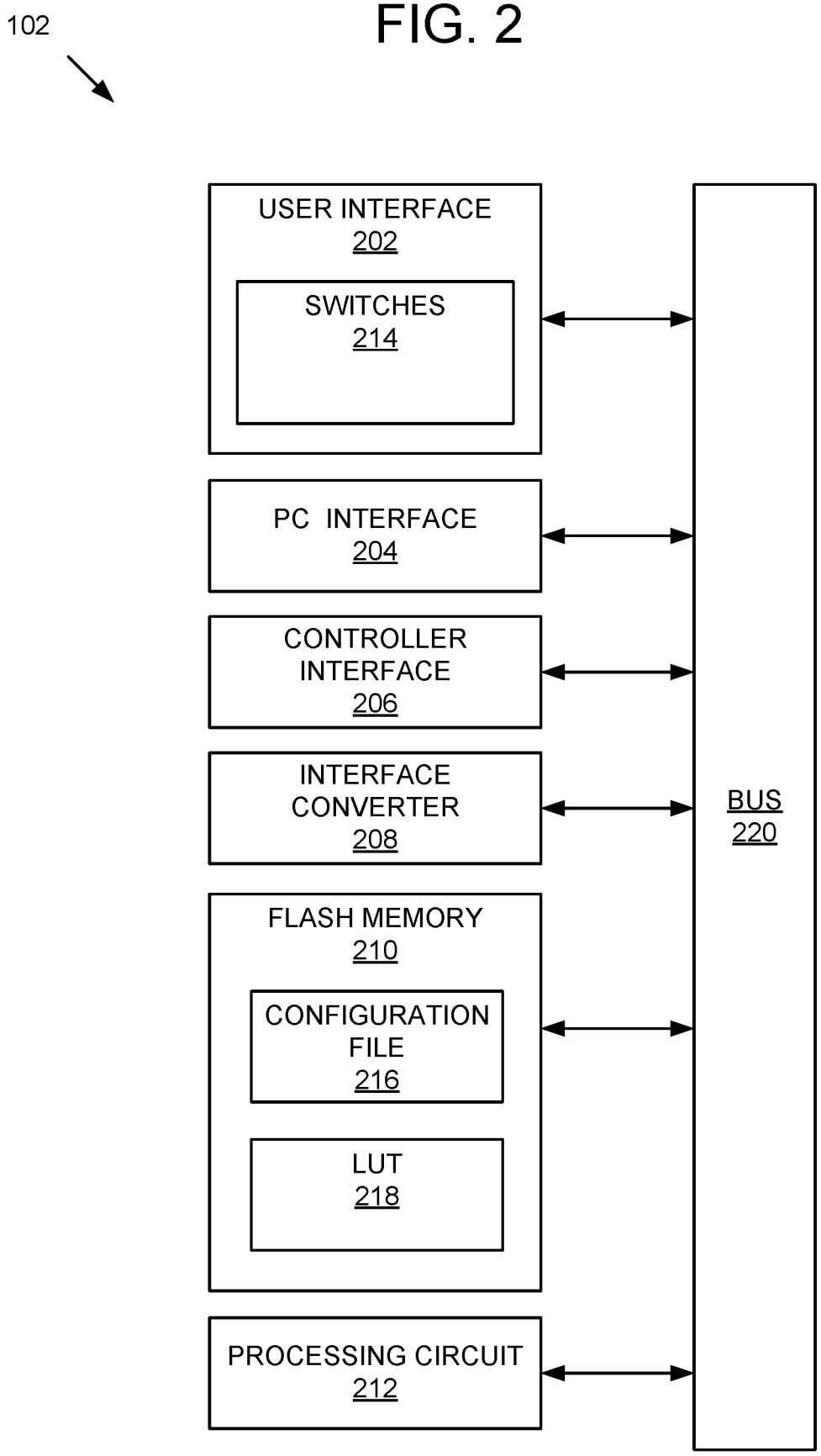
FIG. 2 is a block diagram of the portable device as shown in the HVACR controller system of FIG. 1, according to an exemplary embodiment.

The personal computing device 104 may include a configuration manager 108. The configuration manager 108 is configured to create or update a configuration file 216 as shown in FIG. 2. The configuration file 216 contains all the information for provisioning the HVACR device 106. The configuration file 216 may include configuration parameters including sensor setup for multiple sensors, actuator setup for multiple actuators, backlight setup, and calibration. Each configuration parameter may have a hexadecimal value and a corresponding index. The configuration file 216 may be uploaded to an HVACR controller 110 of the HVACR device 106. In some embodiments, the configuration parameters may be uploaded individually to the HVACR controller 110. In some embodiments, the configuration manager 108 accesses, via the portable device 102, the configuration file 216 located on the HVACR controller 110 in order to update it. The configuration manager 108 may be configured to update a number or types of parameters in the configuration file 216 (herein referred to as a "firmware update"). The configuration file 216 may be implemented as an Extensible Markup Language (XML) file, a JavaScript Object Notation (JSON) file, a plain-text file, or the like. The configuration manager 108 may be a software program that runs on an operating system on the personal computing device 104. In some embodiments, the configuration manager 108 includes a user interface for displaying and editing the configuration file 216. The configuration manager 108 may be configured to send a first command frame 112 to the portable device 102 and receive a first response frame 114 from the portable device 102. The personal computing device 104 can be a laptop, a desktop, a mobile phone, a smart phone, a tablet, or the like. The configuration manager 108 can send the configuration file 216 to a PC interface 204 of the portable device 102. The PC interface 204 can store the configuration file 216 in flash memory 210 of the portable device 102. The configuration manager 108 can store the configuration file 216 in the flash memory 210, via the PC interface 204.

The HVACR device 106 may include the HVACR controller 110. The HVACR controller 110 may be configured to receive inputs from measurement devices and provide control signals to control devices. The measurement devices may include temperature sensors, pressure sensors, lighting sensors, or any other type of measurement device. Control devices may be actuators, chillers, boilers, air handling units, variable air volume units, or any other type of control device. The HVACR controller 110 may be configured to send an I2C identifier 120, for identifying the portable device 102, to the portable device 102. The HVACR controller 110 may be configured to receive an Inter-Integrated Circuit (I2C) command frame 116 from the portable device 102 (e.g. in the form of a request) and send an I2C response frame 118 to the portable device 102. The HVACR controller 110 may include memory configured to store the configuration file 216. The memory may include electrically erasable programmable read-only memory (EEPROM). The memory may include flash memory. The HVACR controller 110 may include one or more processing units. The processing units may process the I2C command frame 116, create the I2C response frame 118, read some or all of the data in the configuration file 216, and write data to some or all of the configuration file 216.

FIG. 2 is a block diagram of the portable device 102 as shown in the HVACR controller system 100 of FIG. 1, according to an exemplary embodiment. The portable device 102 is shown to include a user interface 202, a personal computer (PC) interface 204, a controller interface 206, an interface converter 208, a flash memory 210, and a processing circuit 212. Each of the blocks within the portable device 102 are communicably coupled to one another via a bus 220.

The user interface 202 is shown to include switches 214. In one embodiment, the switches are located on an outer surface of device housing of the portable device. In one embodiment, the switches are user-operable (e.g. a user can physically set the switch in one of two positions and/or adjust the switch from a first position to a second position).

A first switch of the switches 214 may be a read/write switch configured to control whether the controller interface 206 reads or writes the configuration file 216. Responsive to the read/write switch being set to a first position (e.g., "read" or "low"), the user interface 202 may read the configuration file 216 from the HVACR controller 110 and save the configuration file 216 to the flash memory 210, overwriting the previous configuration file. Responsive to the read/write switch being set to a second position (e.g., "write" or "high"), the user interface 202 may write the configuration file 216 to the memory of the HVACR controller 110. A second switch of the switches 214 may be a write protect switch configured to enable or disable overwrite protection. Responsive to the write protect switch being set to a first position (e.g., "no write protect" or "low"), the user interface 202 may overwrite a previous configuration file saved in the flash memory 210 of the portable device 102. Overwriting is accomplished by saving the configuration parameters in the configuration file 216 to address locations in the flash memory 210 corresponding to previous configuration parameters of the previous configuration file. Responsive to the write protect switch being set to a second position (e.g., "write protect" or "high"), the user interface 202 may be prevented from overwriting the previous configuration file saved in the flash memory 210. In some embodiments, responsive to the write protect switch being set to the second position, the configuration parameters in the configuration file 216 are discarded.

In some embodiments, the write protect switch only affects operation of the read/write switch when the read/write switch is set to read the configuration file 216. In other embodiments, the write protect switch affects both operations controlled by the read/write switch. In some embodiments, the switches 214 can be bypassed by enabling an override feature in the configuration manager 108. In some embodiments, the switches 214 affect all modes including pass through mode. The switches 214 may be single-pole, double-throw (SPDT) switches. The switches 214 may be implemented as any type of hardware including, but not limited to, physical switches, mechanical switches, electrical switches, magnetic switches, toggles, sliders, levers, buttons, adjustable knobs, capacitive touchscreens, metal-oxide-semiconductor field-effect transistors (MOSFETs), bipolar switches, and micro-electro-mechanical system (MEMS) switches.

The portable device 102 is shown to include the PC interface 204. The PC interface 204 may be configured to receive the first command frame 112 from the configuration manager 108. The PC interface 204 may be configured to send the first response frame 114 to the configuration manager 108. The PC interface 204 may include a physical connector operable to receive and transmit data upon being connected to a corresponding port on the personal computing device 104. In this regard, the PC interface 204 may be configured to communicate with the configuration manager 108 in response to the physical connector being connected to the corresponding port on the personal computing device 104. In some embodiments, the physical connector is be a universal serial bus (USB) connector. The physical connector may be a recommended standard 232 (RS-232) connector. In some embodiments, the physical connector is operable to receive serial peripheral interface (SPI) data. The physical connector may be operable to receive universal asynchronous receiver-transmitter (UART) data. Transmission of the first command frame 112 or the first response frame 114 may use, or comply with, SPI protocol. In some embodiments, transmission of the first command frame 112 or the first response frame 114 uses, or complies with, UART protocol.

Figure 3A:
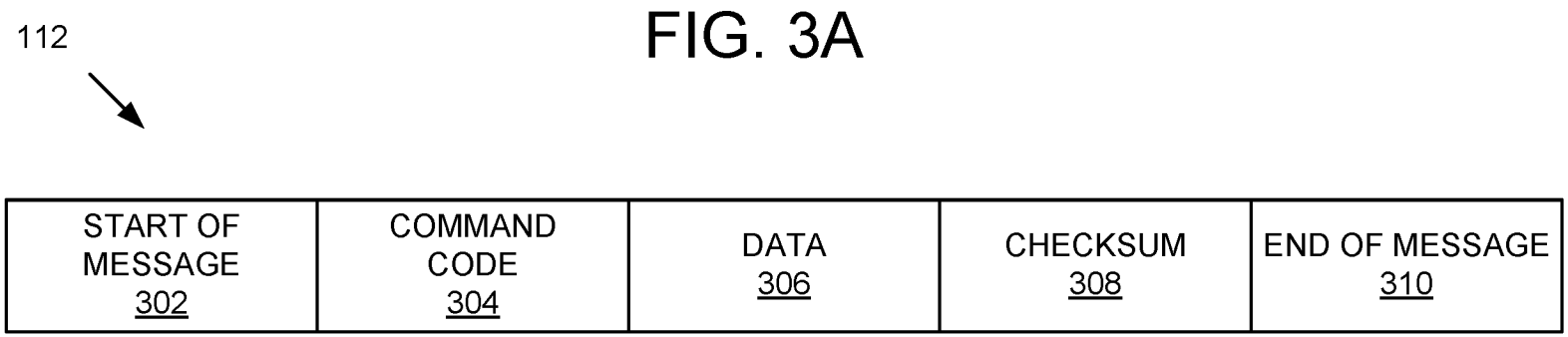
FIG. 3A is a drawing of the first command frame as shown in the HVACR controller system of FIG. 1, according to an exemplary embodiment.

FIG. 3A is a drawing of the first command frame 112 as shown in the HVACR controller system 100 of FIG. 1, according to an exemplary embodiment. The first command frame 112 is shown to include a command code 304. The first command frame 112 may include start of message 302 character, data 306, checksum 308, and end of message 310. Each of the blocks illustrated in the drawing of the first command frame 112 in FIG. 3A may be referred to as a slot.

The command code 304 can correspond to a requested action. Examples of the command code 304 are "A," "B," "S," "R," "U," and "X." "A" may correspond to a first action to read the configuration file 216 that is currently stored on the portable device 102. "B" may correspond to a second action to write the configuration file 216 provided in the first command frame 112 to the portable device 102. "S" may correspond to a third action to retrieve a state of the write protect switch from memory of the portable device. "R" may correspond to a fourth action to retrieve portable device 102 information from the memory. "U" may correspond to a fifth action to command the portable device 102 to enter bootloader mode for firmware updates. "X" may correspond to a sixth action to send or receive data directly with the HVACR controller 110 (e.g. pass through mode).

Some first command frames 112 contain data 306 whereas other first command frames 112 do not contain data 306. Adding the data 306 to a first command frame 112 can cause a primary first command frame 112 to contain more bytes than a second first command frame 112 that does not contain the data 306. The data 306 could vary in length in which case each data 306 byte may be comma delimited.

The checksum 308 may be used to detect accidental changes in raw data. The personal computing device 104 may calculate and send a first checksum 308 in the first command frame 112. The portable device 102 may receive the first checksum 308, calculate a second checksum, and compare the first checksum 308 to the second checksum. If the second checksum matches the first checksum 308, the data may uncorrupted by transmission (e.g. by channel noise or distortion). In some embodiments, the checksum 308 is calculated as a remainder of a ratio of an input binary stream and a polynomial generator. The input binary stream may be n bits. The input binary stream may include the start of message 302, an American Standard Code for Information Interchange (ASCII) representation of the command code 304, some or all of the data 306, the end of message 310, or a combination thereof. The polynomial generator may be n+1 bits. In some embodiments, the polynomial generator is a hexadecimal value of 0x1021, which is the polynomial generator used for CRC-16-CCITT. The checksum 308 may be calculated in other ways or use other polynomial generators in the calculation, without departing from the scope of the present disclosure.

Figure 3B:
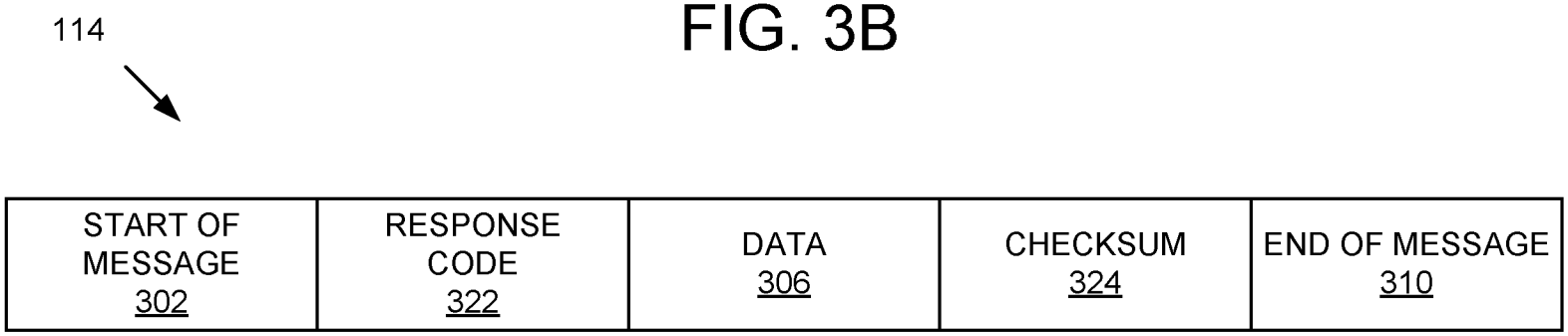
FIG. 3B is a drawing of the first response frame as shown in the HVACR controller system of FIG. 1, according to an exemplary embodiment.

FIG. 3B is a drawing of the first response frame 114 as shown in the HVACR controller system 100 of FIG. 1, according to an exemplary embodiment. The first response frame 114 is similar to the first command frame 112 except that the first response frame 114 may include (a) a response code 322 instead of the command code 304, and (b) a checksum 324 instead of the checksum 308. The response code 322 can include a result identifier indicating whether the command code 304 was successfully executed. In some embodiments, the result identifier indicates that the checksum 308 generated an error, the command code 304 is invalid, or the first command frame 112 length is invalid.

The response code 322 may include the command code 304. The checksum 324 is similar to checksum 308 except that the checksum 324 is calculated by the portable device 102 before sending the first response frame 114.

Referring back to FIG. 2, The portable device 102 is shown to include the controller interface 206. In some embodiments, the controller interface 206 detects whether a first switch of the switches 214 is configured in a read position or a write position. Responsive to detecting that the first switch is configured in the read position, the controller interface 206 can execute a read operation. The read operation may include obtaining configuration parameters from the HVACR controller 110. The read operation may include encoding a primary first command code 304 requesting to read the first set of configuration parameters from the HVACR controller 110. The primary first command code 304 may be encoded from an indicator of the switch position, such as a voltage or current. Responsive to detecting that the first switch is configured in the write position, the controller interface 206 can execute a write operation. The write operation may include sending configuration parameters to the HVACR controller 110. The write operation may include encoding a second first command code 304 requesting to write the first set of configuration parameters to the HVACR controller 110. The second first command code 304 may be encoded from an indicator of the switch position, such as a voltage or current. In some embodiments, the controller interface 206 detects whether a second switch of the switches 214 is configured in an overwrite protect or a non-overwrite protect position. The controller interface 206 may be configured to not store configuration parameters received from the HVACR controller 110 in response to detecting that the second switch is in overwrite protect position. In some embodiments, the controller interface 206 detects that the controller interface 206 is coupled to the HVACR controller 110 by detecting a signal satisfying a threshold. The signal may be a voltage or a current. The signal may be used to energize (e.g. power up) the portable device 102 via the controller interface 206. The signal may be a clock signal such as a signal on a serial clock line.

The controller interface 206 may be configured to receive the I2C identifier 120 from the HVACR controller 110. The controller interface 206 may be configured to send the I2C command frame 116 to the HVACR controller 110. In some embodiments, sending the I2C command frame 116 is responsive to receiving the I2C identifier 120. The controller interface 206 may be configured to receive the I2C response frame 118 from the HVACR controller 110. In some embodiments, receiving the I2C response frame 118 is responsive to sending the I2C command frame 116 to the HVACR controller 110. Transmission between the controller interface 206 and the HVACR controller 110 may be bidirectional. The controller interface 206 and the HVACR controller 110 may be coupled by a serial data (SDA) line and a serial clock (SCL) line. In some embodiments, control of transmission is taken by device that pulls down the SDA line. The controller interface 206 may include a physical connector operable to receive and transmit I2C data upon being connected to a corresponding port on the HVACR device 106. In this regard, the controller interface 206 may be configured to communicate with the HVACR controller 110 responsive to the physical connector being connected to the corresponding port on the HVACR device 106. Transmission of the I2C command frame 116 or the I2C response frame 118 may use, or comply with, I2C protocol.

The I2C identifier 120 may include the address of the portable device 102. Upon the HVACR controller 110 sending the I2C identifier 120, the portable device 102 may pull down the SDA line, thereby taking the control of the transmission. In some embodiments, upon receiving the I2C identifier 120, the controller interface 206 may compare the I2C identifier 120 to a second identifier stored in the flash memory 210. The second identifier may be a unique address associated with the portable device 102. Responsive to determining that the I2C identifier 120 matches the second identifier, the controller interface 206 may pull down the SDA line. In some embodiments, the I2C identifier 120 may include a read/write (R/W) bit. Whether the portable device 102 pulls down the SDA line may be determined by whether read or write is enabled.

Figure 3C:
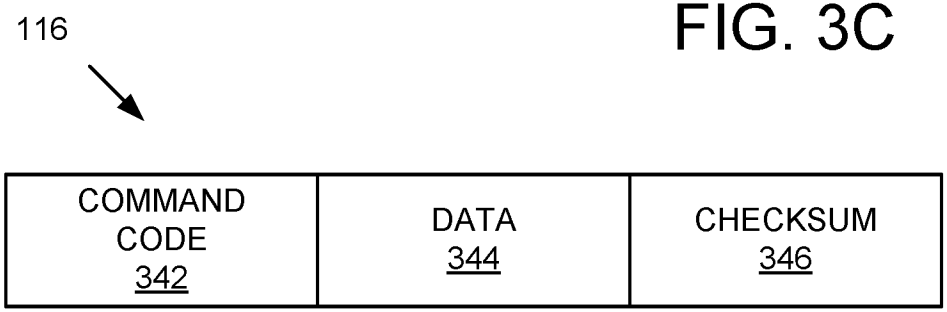
FIG. 3C is a drawing of the I2C command frame as shown in the HVACR controller system of FIG. 1, according to an exemplary embodiment.

FIG. 3C is a drawing of the I2C command frame 116 as shown in the HVACR controller system 100 of FIG. 1, according to an exemplary embodiment. Responsive to pulling down the SDA line, the portable device 102 may send the I2C command frame 116. In some embodiments, responsive to determining that the I2C identifier 120 matches the unique second identifier, the portable device 102 sends the I2C command frame 116 without pulling down the SDA line. In some embodiments, sending the I2C command frame 116 is responsive to all of the following criteria being met: (a) determining that the I2C identifier 120 matches the unique second identifier; and (b) the read/write switch of the switches 214 selecting the read operation.

The I2C command frame 116 may include a command code 342, a data 344, and a checksum 346. Examples of the command code 342 are "CMD_READ_CONFIG" and "CMD_WRITE_CONFIG." "CMD_READ_CONFIG" may correspond to a first action to request to read the configuration parameters that are currently stored on the HVACR controller 110. "CMD_WRITE_CONFIG" may correspond to a second action to request to write the configuration file 216 provided in the I2C command frame 116 to the HVACR controller 110.

The data 344 may be similar to the data 306 except that (a) a length of the data 344 may be different than the length of the data 306, and (b) a number of bits per slot may be different. The checksum 346 may be similar to checksum 308 except that (a) the checksum 346 may be calculated by the portable device 102 before sending the I2C command frame 116, and (b) the checksum 346 may use a different calculation or a different polynomial generator than the checksum 308.

In some embodiments, there is no start of message 302 or end of message 310 in an I2C command frame 116. Frame transmission may initiate responsive to the HVACR controller 110 or the controller interface 206 pulling the SDA low, putting the portable device 102 on notice that transmission may start. Frame transmission may end responsive to the HVACR controller 110 or the controller interface 206 executing a low-to-high transition on the SCL line followed by a low-to-high transition on the SDA, with the SCL remaining high. In other embodiments not shown, the I2C command frame 116 includes the start of message 302 and the end of message 310.

Figure 3D:
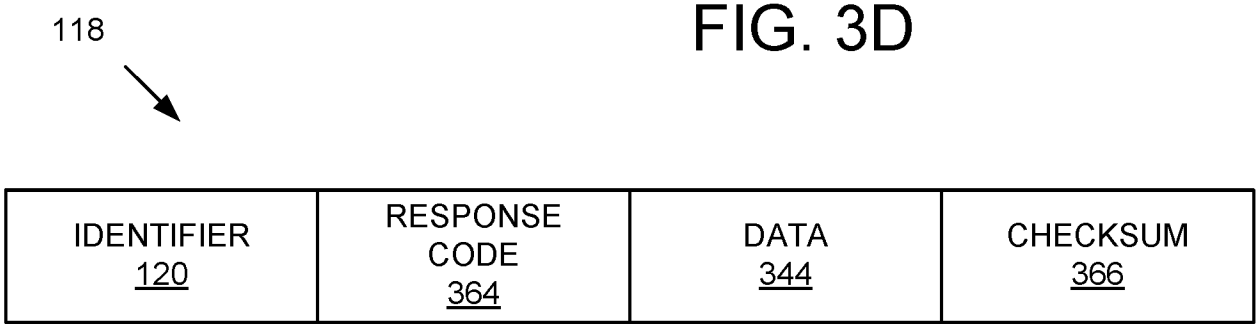
FIG. 3D is a drawing of the I2C response frame as shown in the HVACR controller system of FIG. 1, according to an exemplary embodiment.

FIG. 3D is a drawing of the I2C response frame 118 as shown in the HVACR controller system 100 of FIG. 1, according to an exemplary embodiment. The I2C response frame 118 is similar to the I2C command frame 116 except that the I2C response frame 118 may include the identifier 120 and a response code 364 instead of the command code 342, and a checksum 366 instead of the checksum 346. The checksum 366 is similar to checksum 346 except that the checksum 366 is calculated by the HVACR controller 110 before sending the I2C response frame 118.

Examples of the response code 364 are "READ_CONFIG_RESPONSE" and "WRITE_CONFIG_RESPONSE." "READ_CONFIG_RESPONSE" may correspond to a first action to read the configuration parameters that are currently stored on the HVACR controller 110. In some embodiments, upon reading the configuration parameters from the memory of the HVACR controller 110, the configuration parameters are saved on the portable device 102, overwriting any previous configuration file saved on the portable device 102. "WRITE_CONFIG_RESPONSE" may correspond to a second action to write the configuration file 216 provided in the I2C command frame 116 to the memory of the HVACR controller 110. The configuration parameters of the configuration file 216 may be written to the appropriate sensors, actuators, backlight, and calibration, thereby overwriting previously saved configuration parameters.

Referring back to FIG. 2, the portable device 102 is shown to include the interface converter 208 communicably coupled to the PC interface 204 and the controller interface 206. The interface converter 208 may be configured to enable the pass through mode. In some embodiments, the pass through mode is responsive to receiving a command from the PC interface 204 to send or receive data directly with the HVACR controller 110. The interface converter 208 may be configured to convert first commands frames 112 or first response frames 114 to I2C command frames 116 or I2C command responses 118. The interface converter 208 may be configured to map a first command code 304 received by a personal computing device 104 to an I2C command code 342 to be sent to the HVACR controller 110. In this regard, the interface converter 208 may perform the mapping by accessing a lookup table (LUT) 218, as described below. The interface converter 208 may be configured to convert from a first transmission protocol to a second transmission protocol. For example, the first command frame 112 may be transmitted using a SPI protocol and the I2C command frame 116 may be transmitted using the I2C protocol. The interface converter 208 may change a first format of the first command frame 112 to a second format of the I2C command frame 116. Changing the first format to the second format may include appending or removing slots to the first command frame 112 (e.g. removing the start of message 302 and end of message 310), appending or removing bits to the front or back of one or more of the slots, changing an order of the slots, or changing a length of one or more of the slots (e.g. a number of bits carried per slot). The interface converter 208 may be configured to request the controller interface 206 to pull down an SDA line based on receiving the first command frame 112. The interface converter 208 may convert a first voltage in the first command frame 112 (or the first response frame 114) to a second voltage in the I2C command frame 116 (or the I2C response frame 118), and vice versa, using level shifters. The level shifters may be implemented in hardware such as transistors.

The PC interface 204, the controller interface 206, and/or the interface converter 208 may be implemented in hardware, software, or a combination of hardware and software, in one or more embodiments. For instance, the PC interface 204, the controller interface 206, and/or the interface converter 208 can include any application, program, library, script, task, service, process or any type and form of executable instructions executing on hardware of the portable device 102. The hardware includes circuitry such as one or more processing circuits 212 in one or more embodiments.

In some embodiments, the operations performed by the PC interface 204 and the controller interface 206 are performed by the interface converter 208. The operations performed by the interface converter 208 may be performed by the PC interface 204, the controller interface 206, a combination thereof, or both. In some embodiments, some or all of the operations of the PC interface 204, the controller interface 206, and the interface converter 208 are performed by the processing circuit 212.

The portable device 102 is shown to include the flash memory 210. The flash memory 210 is shown to include the configuration file 216 and the LUT 218. As described above, the configuration file 216 is used for provisioning the HVACR device 106 and has configuration parameters including parameters for sensors, actuators, backlight, and calibration. The LUT 218 may be a data structure with a plurality of command codes (including, for example, the command code 304 or the command code 342). Each command code may be located at an index corresponding to an action or a switch position. A block having access to the LUT 218, such as the PC interface 204 or the controller interface 206, may be able to encode the command code from the action or a switch position. Encoding may be accomplished by finding the action in the LUT 218 and identifying the command code at the index in the LUT 218 corresponding to the action or the switch position. A block having access to the LUT 218 may be able to decode the command code to the action. Decoding may be accomplished by finding the command code in the LUT 218 and identifying the action at the index in the LUT 218 corresponding to the command code. The LUT 218 may include one or more LUTs. In some embodiments, the LUT 218 can include a plurality of first command codes 304 and first response codes 322 for communication with the personal computing device 104. Each first command code 304 may be located at an index corresponding to an I2C command code 342 for communication with the HVACR controller 110. Each first response code 322 may be located at an index corresponding to an I2C response code 364 for communication with the HVACR controller 110. Mapping may be accomplished by finding the first command code 304 (or the first response code 322) in the LUT 218 and identifying the I2C command code 342 (or the I2C command code 364) at the index in the LUT 218 corresponding to the first command code 304 (or first response code 322), or vice versa. In some embodiments, the LUT 218 may include first command codes 304, first response codes 322, I2C command codes 342, I2C response codes 364, actions, and/or indicators of switch positions.

The portable device 102 is shown to include the processing circuit 212 configured to execute instructions. The instructions may be carried out by a special purpose computer, logic circuits, or hardware circuits of the processing circuit 212. The processing circuit 212 may be implemented in hardware, firmware, software, or any combination thereof. The term "execution" is, for example, the process of running an application or the carrying out of the operation called for by an instruction. The instructions may be written using one or more programming language, scripting language, assembly language, etc. The processing circuit 212, thus, execute an instruction, meaning that they perform the operations called for by that instruction.

The processing circuit 212 may be operably coupled to the other blocks of the portable device 102, via the bus 220, to receive, send, and process information, and to control the operations of one or more of the other blocks of the portable device 102. The processing circuit 212 may retrieve a set of instructions from the one or more of the other blocks of the portable device 102. Further, the processing circuit 212 may include a single stand-alone processing unit, or a plurality of processing units that use the same or different processing technology. In some embodiments, some or all of the other blocks of the portable device 102 may have one or more processing circuits 212 to perform operations for the respective block.

Figure 4:
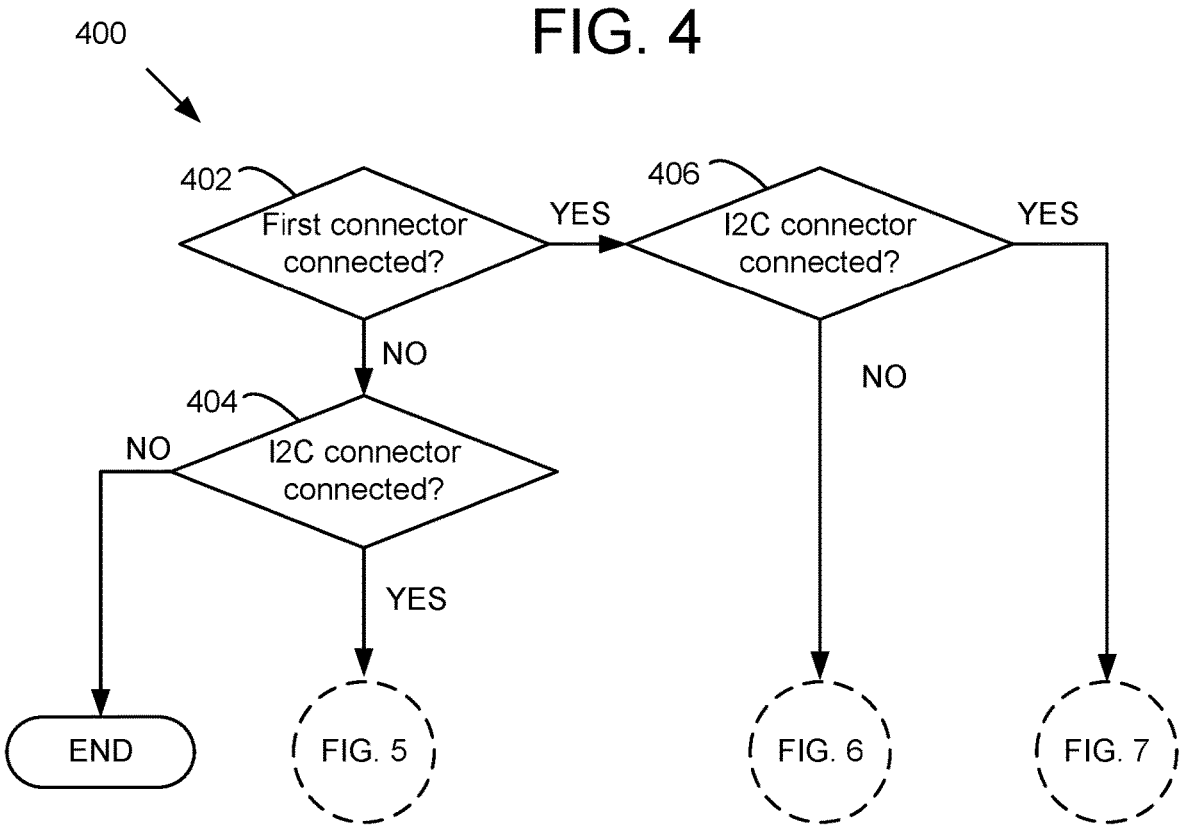
FIG. 4 is a flow chart of a process for determining in which mode to operate the portable device in the HVACR controller system of FIG. 1, according to an exemplary embodiment.

FIG. 4 is a flow chart of a process 400 for operating the portable device 102 in the HVACR controller system 100 of FIG. 1, according to an exemplary embodiment. The process 400 of FIG. 4 may be viewed as part of a bigger process including the process 400 of FIG. 4, process 500 of FIG. 5, process 600 of FIG. 6, and process 700 of FIG. 7, or the process 400 of FIG. 4 may be viewed as a stand-alone process. Additional, fewer, or different operations may be performed in the process 400 depending on the embodiment. At operation 402, the PC interface 204 may determine whether a first connector is connected to the personal computing device 104. At operation 404 and at operation 406, the controller interface 206 may determine whether an I2C connector is connected to the HVACR controller 110. The first connector may be a different connector than the I2C connector. Responsive to determining that the first connector is connected and the I2C connector is not connected, the process 500 of FIG. 5 may start. Responsive to determining that the first connector is not connected and the I2C connector is connected, the process 600 of FIG. 6 may start. Responsive to determining that both connectors are connected, the process 700 of FIG. 7 may start. Responsive to determining that neither connector is connected, the process ends.

Figure 5:
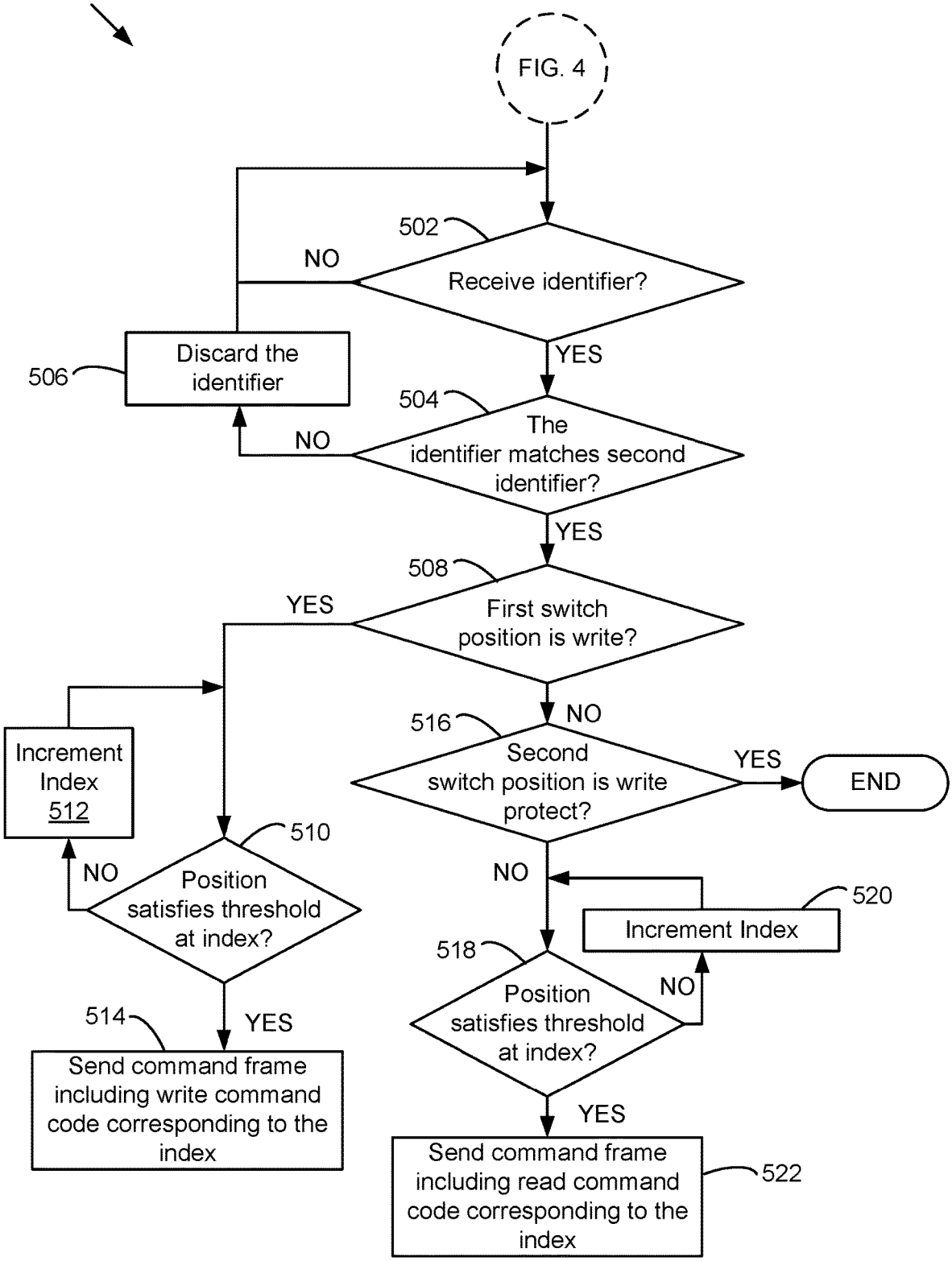
FIG. 5 is a flow chart of a process of operating the portable device with the HVACR controller in the HVACR controller system of FIG. 1, according to an exemplary embodiment.

FIG. 5 is a flow chart of the process 500 of operating the portable device 102 with the HVACR controller 110 in the HVACR controller system 100 of FIG. 1, according to an exemplary embodiment. Additional, fewer, or different operations may be performed in the process 500 depending on the embodiment. At operation 502, the controller interface 206 may determine whether it has received an identifier 120. In some embodiments the identifier 120 is an address. Responsive to the controller interface 206 determining that it has not received the identifier 120, the process 500 may return to the operation 502. Responsive to the controller interface 206 determining that it has received the identifier 120, at operation 504, the controller interface 206 may determine whether the identifier 120 matches a second identifier stored in memory of the portable device 102. In some embodiments, the second identifier is a unique address associated with the portable device 102. Responsive to determining that the identifier 120 does not match the second identifier stored in the memory of the portable device 102, at operation 506, the controller interface 206 may discard the identifier 120, and the process 500 may return to the operation 502. In some embodiments, the controller interface may detect whether the controller interface is coupled to the HVACR controller. The controller interface may detect that the controller interface is coupled to the HVACR controller by detecting that a signal satisfying a threshold. The signal may be a voltage or a current. The signal may be used to energize the portable device via the controller interface. In some embodiments, responsive to detecting that the controller interface is coupled to the HVACR controller, the controller interface detects switch positions.

Responsive to determining that the identifier 120 matches the second identifier stored in the memory of the portable device 102, at operation 508, the controller interface 206 may detect that a first switch of the portable device 102 is set to one of a read position and a write position. In one embodiment, detecting that the first switch is set to a write position includes sensing, by the controller interface, a first voltage satisfying a first threshold. The first switch, depending on a position of the switch, can couple or de-couple the first voltage to the controller interface. In one embodiment, detecting that the first switch is set to a read position includes sensing, by the controller interface, a second voltage satisfying a second threshold. The first switch can, depending on a position of the first switch, couple or de-couple the second voltage to the controller interface. The voltage can be an indicator of the switch position.

Responsive to detecting that the first switch is set to a write position, at operation 510, the controller interface 206 may access an LUT 218 at an index and compare a switch position threshold at the index with the write position indicator. In some embodiments, the index initializes at zero. Responsive to determining that the write position indicator does not satisfy the switch position threshold at the index, at operation 512, the controller interface 206 may increment the index, and the process 500 may return to the operation 510. In one embodiment, the switch position threshold is a voltage range. In some embodiments, prior to operation 512, the controller interface 206 determines whether the index is a maximum index (e.g. the index is equal to a number of actions in the LUT 218 minus one). Responsive to determining that the index is a maximum index, the controller interface 206 may indicate an error and exit the process 500. The error may be indicated by a user interface element, such as a light emitting diode (LED). The error may be reported to the HVACR controller 110. In this regard, the error may be displayed on a user interface associated with the HVACR device 106.

Responsive to determining that write position indicator satisfies the switch position threshold at the index, at operation 514, the controller interface 206 may send a command frame include a write command code 342 requesting to write, the write command code 342 corresponding to the index at which the switch position threshold is located. In some embodiments, the command frame is the I2C command frame 116. In some embodiments, the operations of 510 and 512 may be substituted by other operations that encode a write command code 342, without departing from the scope of the present disclosure.

Responsive to detecting that the first switch is set to a read position, at operation 516, the controller interface 206 may detect that a second switch of the portable device 102 is in one of a overwrite protect position and a non-overwrite protect position. Responsive to detecting that the second switch is set to the overwrite protect position, the process 500 ends. Responsive to detecting that the second switch is set to the non-overwrite protect position, at operation 518, the controller interface 206 may access an LUT 218 at an index and compare a switch position threshold at the index with the read position indicator. Responsive to determining that the read position indicator does not satisfy the switch position threshold at the index, at operation 520, the controller interface 206 may increment the index, and the process 500 may return to the operation 518. Responsive to determining that the read position indicator satisfies the switch position threshold at the index, at operation 522, the controller interface 206 may send a command frame including a read command code 342 requesting to read, the read command code 342 corresponding to the index wherein the second action is located. In some embodiments, encoding the read command code 342 is similar to encoding the write command code 342. In some embodiments, similar operations to those of process 500 may be performed for the HVACR controller 110 sending an I2C response frame 118.

Figure 6:
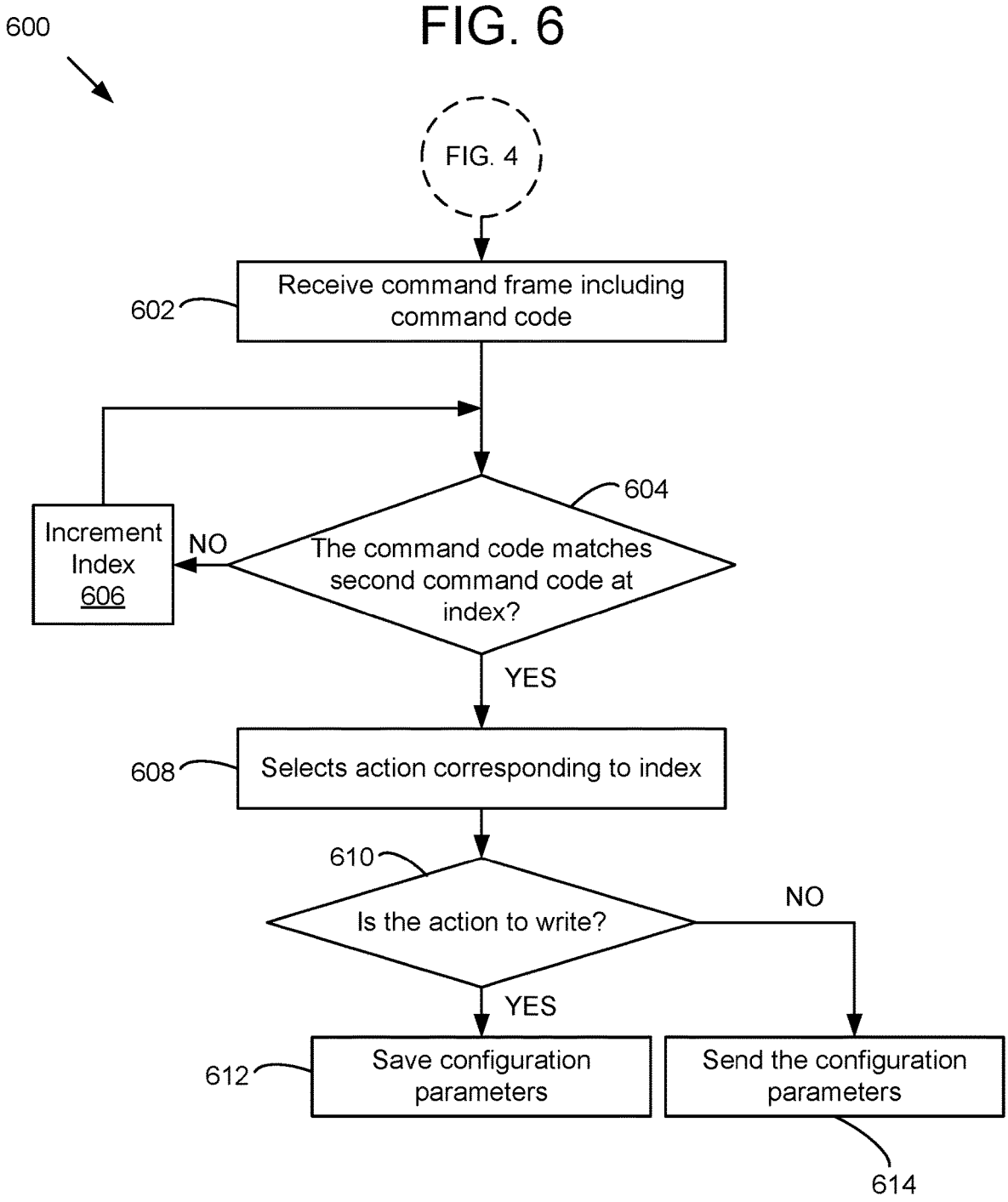
FIG. 6 is a flow chart of a process of operating the portable device with the personal computing device in the HVACR controller system of FIG. 1, according to an exemplary embodiment.

FIG. 6 is a flow chart of the process 600 of operating the portable device 102 with the personal computing device 104 in the HVACR controller system 100 of FIG. 1, according to an exemplary embodiment. Additional, fewer, or different operations may be performed in the process 600 depending on the embodiment. At operation 602, the PC interface 204 may receive a command frame including a command code 342 and configuration parameters. At operation 604, the PC interface 204 may determine whether the command code 342 matches a second command code 342 at an index. Responsive to determining that the second command code 342 at the index does not match the command code 342, at operation 606, the PC interface 204 may increment the index, and the process 600 may return to the operation 604. Responsive to determining that the second command code 342 at the index matches the command code 342, at operation 608, the PC interface 204 may select an action corresponding to the index. Decoding the command code 342 may be accomplished in other ways without departing from the scope of the present disclosure. At operation 610, the PC interface 204 may determine whether the action is to perform a write operation (e.g. from the perspective of the personal computing device 104). Responsive to determining that the action is to perform the write operation, the PC interface 204 may save the configuration parameters. Responsive to determining that the action is not to perform the write operation, the PC interface 204 may send the configuration parameters to the personal computing device 104. In some embodiments, the command frame is the first command frame 112. In some embodiments, operations similar to those of process 600 may be performed for sending the first response frame 114 by the PC interface 204.

Figure 7:
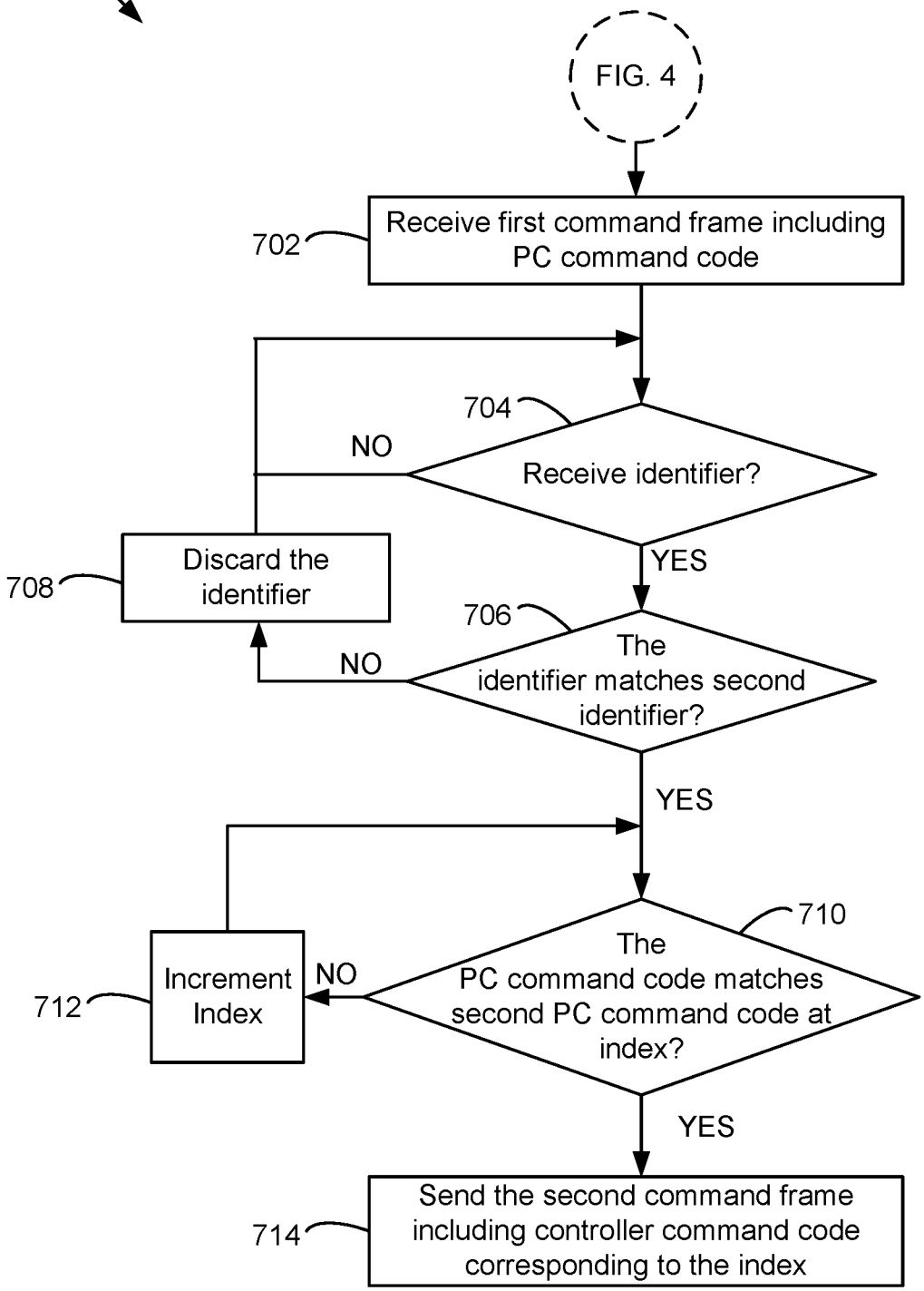
FIG. 7 is a flow chart of a process of operating the portable device in pass through mode in the HVACR controller system of FIG. 1, according to an exemplary embodiment.

FIG. 7 is a flow chart of the process 700 of operating the portable device 102 in the pass through mode in the HVACR controller system 100 of FIG. 1, according to an exemplary embodiment. Additional, fewer, or different operations may be performed in the process 700 depending on the embodiment. At operation 702, the interface converter 208 may receive a first command frame including a PC command code 304. In some embodiments, the transmission of the first command frame uses a first transmission protocol. In some embodiments, the first command frame is the first command frame 112. Operations 704, 706, and 708 are similar to the operations 502, 504, and 506 of FIG. 5 except that the operations 704, 706, and 708 may be performed by the interface converter 208. At operation 710, the interface converter 208 may determine whether the PC command code 304 matches a second PC command code 304 at an index. Responsive to determining that the second PC command code 304 at the index does not match the PC command code 304, at operation 712, the interface converter 208 may increment the index, and the process 700 may return to the operation 710. Responsive to determining that the second PC command code 304 at the index matches the PC command code 304, at operation 714, the interface converter 208 may map the PC command code 304 to a controller command code 342 corresponding to the index and send a second command frame including the controller command code 342. Mapping the PC command code 304 to the controller command code 342 may be accomplished in other ways without departing from the scope of the present disclosure. In some embodiments, the transmission of the second command frame may use a second transmission protocol different from the first transmission protocol. In some embodiments, the second command frame is the I2C command frame 116. In some embodiments, operations similar to those of process 700 may be performed for receiving, by the interface converter 208, the I2C response frame 118, converting, by the interface converter 208, the I2C response frame 118 to the first response frame 114, and sending, by the interface converter 208, the first response frame 114.

CONFIGURATION OF EXEMPLARY EMBODIMENTS

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A portable device for managing heating, ventilation, air conditioning, and refrigeration (HVACR) equipment configuration, the portable device comprising:

a memory storing a first set of configuration parameters;

a device housing;

a first user-operable switch disposed on the device housing and having a read position and a write position;

a second user-operable switch disposed on the device housing and having an overwrite protect position and a non-overwrite protect position; and a controller interface coupled to the memory and the first user-operable switch, and configured to be coupled to an HVACR controller, the controller interface configured to:

detect whether the HVACR controller is coupled to the controller interface;

responsive to detecting that the HVACR controller is coupled to the controller interface, detect whether the first user-operable switch is in the read position or the write position;

responsive to detecting that the first user-operable switch is in the read position, execute a read operation comprising obtaining the first set of configuration parameters from the HVACR controller;

responsive to detecting that the first user-operable switch is in the write position, execute a write operation comprising sending the first set of configuration parameters to the HVACR controller; and responsive to detecting that the first user-operable switch is in the read position and the second user-operable switch is in the overwrite protect position, discard the first set of configuration parameters.

2. The portable device of claim 1, wherein the read operation comprises:

encoding a first command code requesting to read the first set of configuration parameters from the HVACR controller;

sending a first command frame including the first command code to the HVACR controller; and receiving a response frame including the first set of configuration parameters from the HVACR controller in response to sending the first command frame.

3. The portable device of claim 1, wherein:

the controller interface is further configured to, responsive to detecting that the first user-operable switch is in the read position and the second user-operable switch is in the non-overwrite protect position, overwrite a second set of configuration parameters at address locations in the memory by storing the first set of configuration parameters at the address locations in the memory.

4. The portable device of claim 1, wherein the write operation comprises:

encoding a second command code requesting the HVACR controller to save the first set of configuration parameters; and sending a second command frame including the second command code and the first set of configuration parameters to the HVACR controller.

5. The portable device of claim 1, the controller interface further configured to:

receive a first identifier from the HVACR controller; and determine that the first identifier matches a second identifier corresponding to the portable device.

6. The portable device of claim 1, the controller interface further configured to:

receive a first checksum from the HVACR controller;

calculate a second checksum based on the first set of configuration parameters; and responsive to determining that the second checksum matches the first checksum, determine that the first set of configuration parameters is not corrupt.

7. The portable device of claim 1, further comprising a personal computer (PC) interface coupled to the memory and configured to be coupled to a PC.

8. The portable device of claim 7, further comprising an interface converter that is coupled between the PC interface and the controller interface, wherein the PC interface sends a command frame to the controller interface through the interface converter.

9. The portable device of claim 8, wherein the interface converter is configured to convert the command frame from a first format to a second format.

10. A method for managing heating, ventilation, air conditioning, and refrigeration (HVACR) equipment configuration, the method comprising:

detecting whether an HVACR controller is coupled to a controller interface;

detecting whether a first user-operable switch disposed on a device housing of a portable device is in a read position or a write position based on detecting that the HVACR controller is coupled to the controller interface;

detecting whether a second user-operable switch disposed on the device housing is in an overwrite protection position or a non-overwrite protection position;

executing a read operation comprising obtaining a first set of configuration parameters from the HVACR controller based on detecting that the first user operable switch is in the read position;

executing a write operation comprising sending the first set of configuration parameters to the HVACR controller based on detecting that the first user-operable switch is in the write position; and discard the first set of configuration parameters based on detecting that the first user operable switch is in the read position and the second user operable switch is in the overwrite protect position.

11. The method of claim 10, wherein the read operation comprises:

encoding a first command code requesting to read the first set of configuration parameters from the HVACR controller;

sending a first command frame including the first command code to the HVACR controller; and receiving a response frame including the first set of configuration parameters from the HVACR controller in response to sending the first command frame.

12. The method of claim 10, further comprising:

responsive to detecting that the first user-operable switch is in the read position and the second user-operable switch is in the non-overwrite protect position, overwriting a second set of configuration parameters at address locations in a memory of the portable device by storing the first set of configuration parameters at the address locations in the memory.

13. The method of claim 10, wherein the write operation comprises:

encoding a second command code requesting the HVACR controller to save the first set of configuration parameters; and sending a second command frame including the second command code and the first set of configuration parameters to the HVACR controller.

14. The method of claim 10, further comprising:

receiving a first identifier from the HVACR controller; and determining that the first identifier matches a second identifier corresponding to the portable device.

15. The method of claim 10, further comprising:

receiving a first checksum from the HVACR controller;

calculating a second checksum based on the first set of configuration parameters; and responsive to determining that the second checksum matches the first checksum, determining that the first set of configuration parameters is not corrupt.

16. A system for managing heating, ventilation, air conditioning, and refrigeration (HVACR) equipment configuration, the system comprising:

an HVACR controller; and a portable device comprising:

a memory storing a first set of configuration parameters;

device housing;

a first user-operable switch disposed on the device housing and having a read position and a write position;

a second user-operable switch disposed on the device housing and having an overwrite protect position and a non-overwrite protect position; and a controller interface coupled to the memory and the first user-operable switch, and configured to be coupled to the HVACR controller, the controller interface configured to:

detect whether the HVACR controller is coupled to the controller interface;

responsive to detecting that the HVACR controller is coupled to the controller interface, detect whether the first user-operable switch is in the read position or the write position;

responsive to detecting that the first user-operable switch is in the read position, execute a read operation comprising obtaining the first set of configuration parameters;

responsive to detecting that the first user-operable switch is in the write position, execute a write operation comprising sending the first set of configuration parameters; and responsive to detecting that the first user-operable switch is in the read position and the second user-operable switch is in the overwrite protect position, discard the first set of configuration parameters.

17. The system of claim 16, wherein the read operation comprises:

encoding a first command code requesting to read the first set of configuration parameters from the HVACR controller;

sending a first command frame including the first command code to the HVACR controller; and receiving a response frame including the first set of configuration parameters from the HVACR controller in response to sending the first command frame.

18. The system of claim 16, wherein:

the controller interface is further configured to, responsive to detecting that the first user-operable switch is in the read position and the second user-operable switch is in the non-overwrite protect position, overwrite a second set of configuration parameters at address locations in the memory by storing the first set of configuration parameters at the address locations in the memory.

19. The system of claim 16, wherein the write operation comprises:

encoding a second command code requesting the HVACR controller to save the first set of configuration parameters; and sending a second command frame including the second command code and the first set of configuration parameters to the HVACR controller.

20. The system of claim 16, the portable device further comprising a personal computer (PC) interface coupled to the memory and the first user-operable switch, the system further comprising a PC coupled to the PC interface, the PC comprising a configuration manager, the configuration manager configured to:

receive user selection of the first set of configuration parameters; and responsive to receiving the user selection of the first set of configuration parameters, store the first set of configuration parameters in the memory, via the PC interface.

* * * * *